US009850101B2

(12) United States Patent
Lee

(10) Patent No.: US 9,850,101 B2
(45) Date of Patent: Dec. 26, 2017

(54) SAFE OPERATION-STOP METHOD FOR ESCALATOR

(71) Applicant: MIJUHITEC CO., LTD., Seoul (KR)

(72) Inventor: Ho Yeon Lee, Seoul (KR)

(73) Assignee: MIJUHITEC CO., LTD, Seoul (KR)

( * ) Notice: Subject to any disclaimer, the term of this patent is extended or adjusted under 35 U.S.C. 154(b) by 0 days.

(21) Appl. No.: 15/317,081

(22) PCT Filed: Jun. 5, 2015

(86) PCT No.: PCT/KR2015/005688

§ 371 (c)(1),
(2) Date: Dec. 7, 2016

(87) PCT Pub. No.: WO2015/190764

PCT Pub. Date: Dec. 17, 2015

(65) Prior Publication Data

US 2017/0129745 A1 May 11, 2017

(30) Foreign Application Priority Data

Jun. 10, 2014 (KR) ..... 10-2014-0070174

(51) Int. Cl.
*B66B 25/00* (2006.01)
*B66B 29/00* (2006.01)

(52) U.S. Cl.
CPC ..... *B66B 29/00* (2013.01)

(58) Field of Classification Search
CPC ..... B66B 25/00; B66B 27/00; B66B 29/00
USPC ..... 198/322, 323
See application file for complete search history.

(56) References Cited

U.S. PATENT DOCUMENTS 5,526,256 A * 6/1996 Sakata ..... B66B 29/005 198/323
6,112,166 A * 8/2000 Joosten ..... B66B 27/00 198/323
2008/0041692 A1* 2/2008 Boom ..... B66B 25/00 198/323
2009/0294247 A1* 12/2009 Xu ..... B66B 29/00 198/323
2011/0011700 A1* 1/2011 Plathin ..... B66B 29/005 198/323
2013/0228417 A1 9/2013 Tautz et al.

FOREIGN PATENT DOCUMENTS

JP 2006-036397 2/2006
JP 2008-037602 2/2008
JP 2010-006486 1/2010
JP 2011-148633 8/2011

(Continued)

*Primary Examiner* — James R Bidwell
(74) *Attorney, Agent, or Firm* — Kramer Amado, P.C.

(57) ABSTRACT

The present invention relates to a safe operation-stop method for an escalator for safely operating and stopping an escalator that senses an abnormal speed of the escalator so as to prevent passengers from falling. A safe operation-stop method for an escalator is provided, the method including sensing an abnormal speed of the escalator and stopping the escalator before it is reversely rotated, and being capable of reliable braking when an abnormal speed of the escalator occurs, thereby preventing passengers from falling by adjusting the inertial stopping distance when braking.

10 Claims, 4 Drawing Sheets

(56) References Cited

FOREIGN PATENT DOCUMENTS

| | | | |
|---|---|---|---|
| JP | 2013-049539 | | 3/2013 |
| KR | 100995059 | B1 | 11/2010 |
| KR | 1020117030796 | | 10/2013 |

* cited by examiner

SAFE OPERATION-STOP METHOD FOR ESCALATOR

BACKGROUND OF THE INVENTION

Field of the Invention

The present invention relates to a method for safely stopping the operation of an escalator and, more particularly, to a method for safely stopping the operation of an escalator, wherein an abnormal speed of an escalator is detected and the operation of the escalator is safely stopped in order to prevent a fall of a passenger.

Discussion of the Related Art

As noted, there have been suggested conventional technologies for stopping an escalator when abnormality is generated in the escalator. A representative example includes Korean Patent No. 10-0995059 entitled "Safety Brake Control Apparatus for Emergency Stop of Escalator" (hereinafter referred to as a "cited invention").

As shown in FIG. 1, cited invention may include the steps of checking whether an escalator ascends or descends, detecting whether counter rotation is generated using a counter rotation detection sensor if the escalator ascends and detecting a descending speed using an overspeed detection sensor if the escalator descends; blocking the supply of power to a driving motor and driving a main brake by sending a block signal to the safety circuit of a main control panel if a descending speed of the escalator detected by the overspeed detection sensor exceeds 120% of a rating speed; and driving an emergency stop safety brake by driving a relay panel if counter rotation is detected by the counter rotation detection sensor or a descending speed of the escalator detected by the overspeed detection sensor exceeds 140% of the rating speed.

Such a cited invention can prevent a safety accident attributable to a malfunction of the escalator by stopping the escalator by the emergency stop safety brake having a braking power according to the friction contact of a disk brake when counter rotation is detected by the counter rotation detection sensor or the overspeed operation of the escalator is detected by the overspeed detection sensor. However, such a stop method corresponds to a friction stop and thus has a problem in that the braking power is reduced because the disk brake of the emergency stop safety brake is worn out as it is used. The emergency stop safety brake has a reduced braking power as described above or is useless if it left as it has a problem in operation because the emergency stop safety brake is not always used, but is used when abnormality is generated. Furthermore, in the cited invention, braking is performed after counter rotation is detected by the counter rotation detection sensor. The cited invention has a problem in that a fall of a passenger is increased because braking is performed when the driving chain is broken and stopped while the escalator ascends and is accelerated in the descending direction by counter rotation.

SUMMARY OF THE INVENTION

An object of the present invention is to provide a method for safely stopping the operation of an escalator, which stops an escalator prior to counter rotation by detecting an abnormal speed of the escalator, performs reliable braking when an abnormal speed of the escalator is generated, and prevents a fall of a passenger by adjusting a stop distance according to inertia when such braking is performed.

According to an aspect of the present invention, there is provided a method for safely stopping the operation of an escalator including a driving motor equipped with a main brake, a main control panel for controlling the driving motor, an emergency brake apparatus for performing emergency braking on the escalator, and a brake unit for controlling the emergency brake apparatus, wherein the main control panel and the brake unit communicate with each other, the driving motor and the driving sprocket of a driving shaft are connected by a driving chain, and a step sprocket rotated when the driving shaft is rotated by the motive power of the driving motor drives a step connected on an endless track through step chains, the method comprising:

a characteristic storage step for storing, by the brake unit, characteristics of the escalator while the escalator is configured and started up; a braking step for dividing, by the brake unit, a moving speed of the escalator into multiple stages, determining abnormality, and performing braking based on the determination; and a test braking step for performing, by the brake unit, test braking in order to test the emergency brake apparatus when the operation of the escalator is normally terminated.

DETAILED DESCRIPTION OF THE EMBODIMENTS

A method for safely stopping the operation of an escalator including a driving motor, a main control panel for controlling the driving motor, an emergency brake apparatus for performing emergency braking on the escalator, and a brake unit for controlling the emergency brake apparatus, wherein the main control panel and the brake unit communicate with each other, the driving motor and the driving sprocket of a driving shaft are connected by a driving chain, and a step sprocket rotated when the driving shaft is rotated by the motive power of the driving motor drives a step connected on an endless track through step chains, the method comprising:

a characteristic storage step for storing, by the brake unit, characteristics of the escalator while the escalator is configured and started up; a braking step for dividing, by the brake unit, a moving speed of the escalator into multiple stages, determining abnormality, and performing braking based on the determination; and a test braking step for performing, by the brake unit, test braking in order to test the emergency brake apparatus when the operation of the escalator is normally terminated.

Embodiments of the present invention are described in detail below with reference to the accompanying drawings so that those skilled in the art to which the present invention pertains readily implement the present invention.

Figure 1:
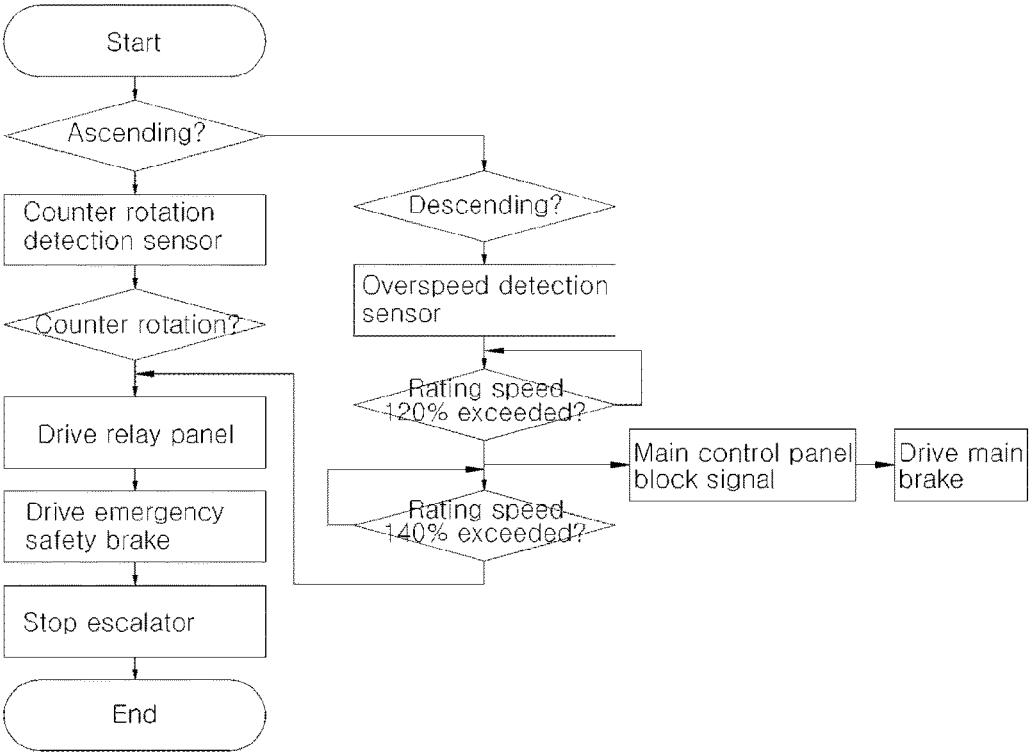
FIG. 1 is a perspective view showing the configuration of cited invention.
Figure 2:
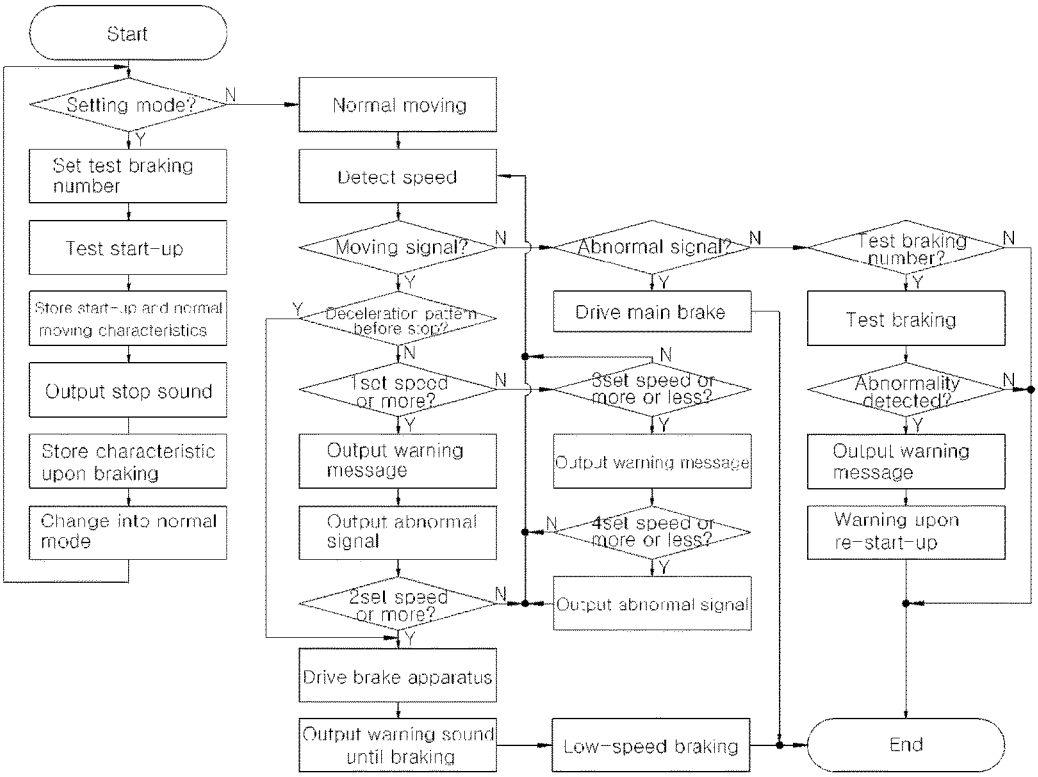
FIG. 2 is a flowchart illustrating an overall configuration of a method for safely stopping the operation of an escalator according to the present invention.
Figure 3:
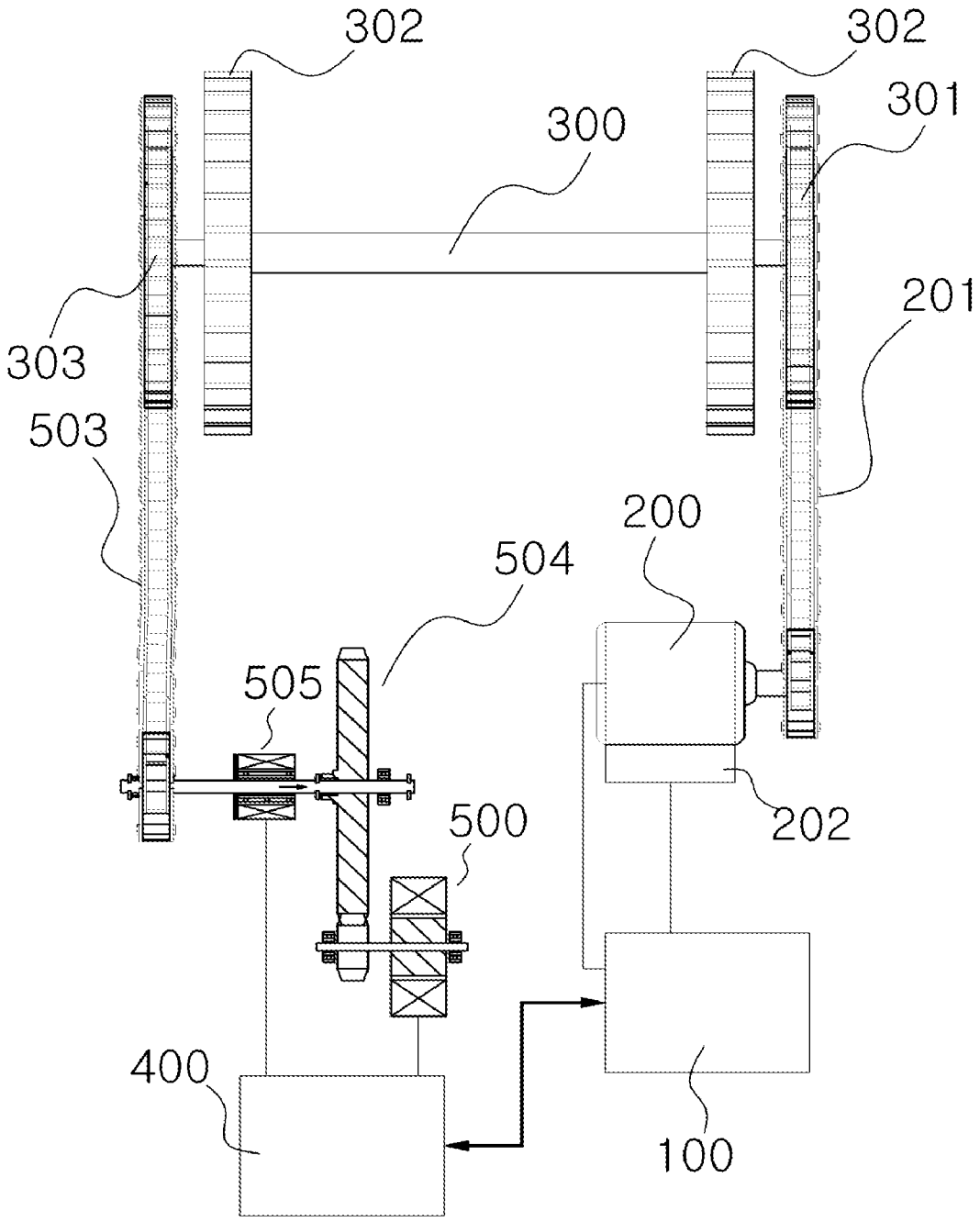
FIG. 3 shows a detailed configuration of an emergency brake apparatus applied to the method for safely stopping the operation of an escalator according to the present invention.

An overall configuration of a method for safely stopping the operation of an escalator according to the present invention is shown in FIG. 3.

Referring to FIG. 3, an escalator according to the present invention includes a driving motor 200 equipped with a main brake 202, a main control panel 100 controlling the driving motor 200, an emergency brake apparatus 500 performing emergency braking on the escalator, and a brake unit 400 controlling the emergency brake apparatus 500.

The main control panel 100 and the brake unit 400 communicate with each other. The driving motor 200 and the driving sprocket 301 of a driving shaft 300 are connected by a driving chain 201. A step sprocket 302 rotated when the driving shaft 300 is rotated by the motive power of the driving motor 200 drives a step connected on an endless track through step chains.

A method for safely stopping the operation of the escalator may includes:

a characteristic storage step for storing, by the brake unit 400, the characteristics of the escalator while the escalator is configured and started up, a braking step for dividing, by the brake unit 400, a moving speed of the escalator into multiple stages, determining abnormality, and performing braking based on the determination, and a test braking step for performing, by the brake unit 400, test braking in order to test the emergency brake apparatus 500 when the operation of the escalator is normally terminated.

Each of the elements is described in more detail below. The main control panel 100 and the brake unit 400 may be configured using a single control apparatus. If the main control panel 100 and the brake unit 400 are separately configured, they communicate with each other. The main control panel 100 starts up and stops the escalator, and outputs a normal moving signal to the brake unit 400 during a normal operation. When an abnormal signal is received from the brake unit 400, the main control panel 100 blocks output of the normal moving signal and stops the escalator by driving the main brake 202. The brake unit 400 determines abnormality by detecting an operation speed of the escalator and performs control for emergency braking on the escalator.

Furthermore, the characteristic storage step may include a test braking number setting step for counting the number of normal operation terminations when the operation of the escalator is terminated, performing emergency braking by the emergency brake apparatus 500 other than common braking by the main brake 202 at a point of time at which the operation of the escalator is terminated when a specific number of operations is reached, and setting a test braking number so that the operation test of the emergency brake apparatus 500 can be executed, a step for setting the escalator in a setting mode, starting up the escalator for a test, and storing a start-up characteristic from the stop state of the escalator to the normal moving state of the escalator and a normal moving characteristic in the normal moving state, and a step for storing a braking characteristic upon braking and a before-stop deceleration characteristic right before the escalator is stopped in the normal moving state of the escalator that moves in the setting mode.

An acceleration time in normal operation may be set based on the start-up characteristic. A normal speed may be set based on the normal moving characteristic. A first setting speed and a second setting speed may be set depending on a degree of overspeed based on the normal speed. A third setting speed and a fourth setting speed may be set depending on a degree of deceleration based on the normal speed. A deceleration time may be set based on the braking characteristic.

By repeatedly performing such a characteristic storage step, a start-up characteristic, a normal moving characteristic, a braking characteristic, and a deceleration characteristic prior to a stop according to an installation environment or the deflection and state of a machine itself may be set as average values for each escalator. The first setting speed to the fourth setting speed, that is, criteria for an abnormal determination, can be set based on such characteristic values. Accordingly, the abnormality of an escalator can be determined more accurately and reliably.

Furthermore, the braking step may include:

a primary overspeed regulation step for determining the escalator to move at overspeed if a moving speed of the escalator detected by the brake unit 400 is a set first setting speed or more in the state in which the escalator has started up in a normal mode and the main control panel 100 outputs a moving signal indicating that the escalator normally moves, sending, by the brake unit 400, an abnormal signal to the main control panel 100, outputting a warning message, and stopping, by the main control panel 100, the escalator by driving the main brake 202 of the driving motor 200, a secondary overspeed braking step for determining that the escalator is suddenly accelerated because the driving chain 201 is broken while the escalator descends if the moving speed of the escalator is a set second setting speed or more, driving, by the brake unit 400, the emergency brake apparatus 500, and outputting a warning message, a primary deceleration regulation step for determining the escalator to be an overload state if the moving speed of the escalator is a set third setting speed or less and outputting, by the brake unit 400, a warning message indicative of the overload state of the escalator through an LED, a speaker, a display and/or a text message in order to prevent no more boarding, a secondary deceleration the braking step for determining that the escalator has been suddenly decelerated because an object is got between the steps of the escalator if the moving speed of the escalator is a set fourth setting speed or less and sending, by the brake unit 400, an abnormal signal to the main control panel 100 so that the escalator is immediately stopped, and a before-counter rotation emergency braking step for determining that the driving chain 201 has been broken while the escalator ascends when the brake unit 400 receives a moving signal from the main control panel 100 and a deceleration characteristic prior to a stop for the escalator is detected, stopping the escalator by driving the emergency brake apparatus 500 before the escalator descends, and outputting a warning message.

Figure 4:
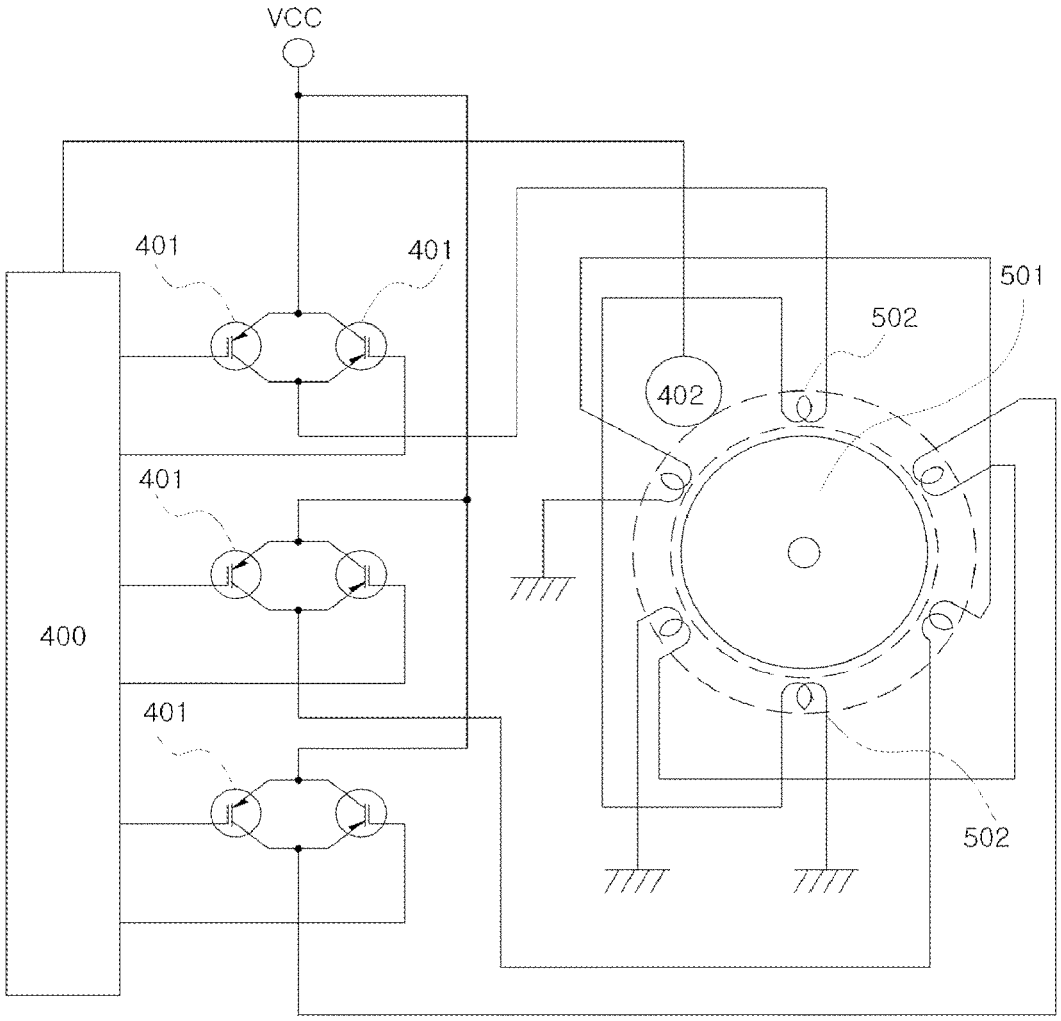
FIG. 4 is a detailed circuit diagram of the emergency brake apparatus applied to the method for safely stopping the operation of an escalator according to the present invention.

More specifically, as illustrated in FIGS. 3 and 4, in the secondary overspeed braking step, the emergency brake apparatus 500 configured using a permanent magnet motor is connected to the driving shaft 300 of the escalator through an electronic clutch 505. The emergency brake apparatus 500 may be separated from the driving shaft 300 at normal times. When a moving speed of the escalator is suddenly accelerated at a set second setting speed or more, the brake unit 400 drives the electronic clutch 505 so that the driving shaft 300 and the permanent magnet motor are connected. Accordingly, the escalator can be decelerated and braked by power generation braking of the permanent magnet motor. As shown in FIG. 4, Insulated Gate Bipolar Transistors (IGBTs), that is, a plurality of switching means 401, is connected to a plurality of windings, that is, the stators 502 of the permanent magnet motor. Furthermore, a stop distance according to inertia upon braking performed by the brake unit 400 for controlling a rotation load applied to the rotor 501 of the permanent magnet motor by supplying an operation pulse to the switching means 401 can be adjusted. Accordingly, a fall of a passenger occurring when the escalator is decelerated and braked during overspeed can be prevented.

As described above, in the braking step, an abnormal state which may occur in the escalator is determined to be multiple stages based on a moving speed of the escalator, and braking suitable for each situation is performed. Accordingly, the operation of the escalator can be safely stopped because a braking method, a braking distance, and a braking speed can be controlled in order to prevent the expansion of a safety accident to a human life accident when passengers who stand on the escalator fall down while the escalator moves.

Furthermore, in general, the escalator includes the driving motor 200 equipped with the main brake 202. The escalator is started up by driving the driving motor 200 under the control of the main control panel 100. The driving motor 200 is stopped by driving the main brake 202, thereby stopping the escalator. When the driving chain 201 is broken and common abnormality other than the state in which braking is not performed due to the stop of the driving motor 200 is generated, braking is performed by the main brake 202.

Accordingly, the emergency brake apparatus 500 that is less frequently used may corrode, an alien substance may be cut in the emergency brake apparatus 500, or an abnormal state, such as a modification or the cutting of a wire may occur in the emergency brake apparatus 500. It is difficult to previously detect factors that generate a problem in the normal operation of the emergency brake apparatus 500. Accordingly, there is a problem in that a safety accident is expanded due to the abnormal operation of the emergency brake apparatus 500 when abnormality is generated in the escalator.

An embodiment of the present invention includes a test braking step in order to improve reliability of the safe stop of the operation of the escalator by solving such a problem. The test braking step may include:

a test notification step for counting, by the brake unit 400, the normal termination of the escalator and providing notification of a test for the emergency brake apparatus 500 upon operation stop when the counted normal termination number reaches a set test braking number, a test step for performing, by the brake unit 400, test braking by driving the emergency brake apparatus 500 after the test notification step, a determination step for detecting, by the brake unit 400, output electricity output by the emergency brake apparatus 500 in the test step and determines whether the emergency brake apparatus 500 is abnormal, an abnormality notification step for providing notification that the emergency brake apparatus 500 is abnormal if the emergency brake apparatus 500 is determined to be abnormal in the determination step, and a re-start-up notification step for providing notification of the abnormality of the emergency brake apparatus 500 if the escalator is started up again in the state in which the abnormality of the emergency brake apparatus 500 has not been solved.

Accordingly, in accordance with the present invention, the emergency brake apparatus 500 is periodically checked and tested at normal times. When abnormality is detected, the abnormality of the emergency brake apparatus 500 can be solved in advance before an accident occurs. Accordingly, the safety of the escalator can be further improved because the operation of the emergency brake apparatus 500 is reliably performed when the escalator is abnormal.

As described above, according to the present invention, abnormality in the escalator is determined when overspeed or deceleration is detected while the escalator operates depending on characteristics of the escalator, and braking suitable for each situation is performed. Furthermore, while the escalator ascends based on a before-stop deceleration characteristic, when the driving chain is broken and stopped, before the escalator descends, abnormality in the escalator is detected. Accordingly, the emergency brake apparatus is driven when the escalator is stopped before it is reversed. Accordingly, a fall of a passenger can be prevented and effective braking can be performed.

In the test braking step, the emergency brake apparatus is periodically checked and tested at normal times. Accordingly, when abnormality is detected, the abnormality of the emergency brake apparatus can be solved in advance before an accident occurs. Accordingly, there is an advantage in that the safety of the escalator can be further improved because the operation of the emergency brake apparatus is reliably performed when abnormality is generated in the escalator.

Furthermore, in the present invention, if the emergency brake apparatus is configured using a permanent magnet motor, the permanent magnet motor is connected to the driving shaft of the escalator through the electronic clutch. At normal times, the emergency brake apparatus is separated from the driving shaft of the escalator. When a moving speed of the escalator is a set second setting speed or more, the driving shaft and the permanent magnet motor are connected by the operation of the electronic clutch. Accordingly, the escalator is decelerated and braked by power generation braking of the permanent magnet motor. Furthermore, the plurality of switching means is connected to the plurality of windings, that is, the stators of the permanent magnet motor. A stop distance according to inertia upon braking can be adjusted by the brake unit for controlling a rotation load applied to the rotor of the permanent magnet motor by supplying an operation pulse to the switching means. Accordingly, there is an advantage in that a fall of a passenger upon deceleration braking during overspeed can be prevented.

As described above, the present invention is not limited to the aforementioned embodiments, but may be changed and implemented in various ways without departing from a gist and concept intended by the present invention.

What is claimed is:

1. A method for safely stopping operation of an escalator comprising a driving motor, a main control panel for controlling the driving motor, an emergency brake apparatus configured to perform emergency braking on the escalator, and a brake unit configured to control the emergency brake apparatus, wherein the main control panel and the brake unit are configured to communicate with each other, the driving motor and a driving sprocket of a driving shaft are connected by a driving chain, and a step sprocket is configured to rotate when the driving shaft is rotated by a motive power of the driving motor that is configured to drive a step connected on an endless track through step chains, the method comprising:

a characteristic storage step for storing, by the brake unit, start-up, normal moving, braking, and deceleration characteristics of the escalator while the escalator is configured and started up;

a braking step for dividing, by the brake unit, a moving speed of the escalator into multiple stages that are respectively based upon the stored characteristics of the escalator, determining an abnormality, and performing braking based on the determination; and a test braking step for performing, by the brake unit, test braking in order to test the emergency brake apparatus when the operation of the escalator is normally terminated.

2. The method of claim 1, wherein the characteristic storage step further comprises:

a test braking number setting step for an operation test of the emergency brake apparatus when the operation of the escalator is terminated;

a step for storing a start up characteristic when the escalator is started up from a stop state of the escalator and a normal moving characteristic when the escalator is in a normal moving state; and a step for storing a characteristic upon braking when the escalator is in a normal moving state and a before-stop deceleration characteristic right before the escalator is stopped.

3. The method of claim 1, wherein the braking step further comprises:

a primary overspeed regulation step for sending, by the brake unit, an abnormal signal to the main control panel when the moving speed of the escalator is a set first setting speed or more and outputting a warning message;

a secondary overspeed braking step for driving, by the brake unit, the emergency brake apparatus when the moving speed of the escalator is a set second setting speed or more and outputting the warning message;

a primary deceleration regulation step for outputting, by the brake unit, the warning message when the moving speed of the escalator is a set third setting speed; and a secondary deceleration braking step for sending, by the brake unit, an abnormal signal to the main control panel when the moving speed of the escalator is a set fourth setting speed or less so that the escalator is stopped.

4. The method of claim 3, wherein the secondary overspeed braking step further comprises:

connecting the emergency brake apparatus, comprising a permanent magnet motor, to the driving shaft of the escalator through an electronic clutch;

connecting the emergency brake apparatus to the driving shaft at normal times, and connecting the driving shaft and the permanent magnet motor by driving the electronic clutch so that the escalator is decelerated and braked by power generation braking of the permanent magnet motor when the moving speed of the escalator is at least the set second setting speed.

5. The method of claim 1, wherein the braking step further comprises:

receiving, by the brake unit, a moving signal from the main control panel;

considering the driving chain to be broken while the escalator ascends when a before-stop deceleration characteristic of the escalator is detected;

stopping the escalator by driving the emergency brake apparatus before the escalator descends; and outputting a warning message.

6. The method of claim 1, wherein the test braking step further comprises:

a test notification step for counting, by the brake unit, a normal termination number of the escalator and providing notification of a test for the emergency brake apparatus upon an operation stop when the counted normal termination number reaches a set test braking number;

a test step for performing, by the brake unit, test braking by driving the emergency brake apparatus after the test notification step;

a determination step for detecting, by the brake unit, electricity output by the emergency brake apparatus in the test step and determining whether the emergency brake apparatus is abnormal;

an abnormality notification step for providing notification that the emergency brake apparatus is abnormal when the emergency brake apparatus is determined to be abnormal in the determination step; and a re-start-up notification step for providing notification that the emergency brake apparatus is abnormal when the escalator is moved again in a state in which potential abnormality of the emergency brake apparatus has not been solved.

7. The method of claim 1, further comprising:

setting an acceleration time in normal operation based on the start-up characteristic.

8. The method of claim 1, further comprising:

setting a normal speed based on the normal moving characteristic.

9. The method of claim 3, further comprising:

setting the first setting speed and the second setting speed based on a degree of overspeed and a normal speed.

10. The method of claim 3, further comprising:

setting the third setting speed and the fourth setting speed based on a degree of deceleration and a normal speed.

* * * * *